US011242644B2

(12) United States Patent
Buso et al.

(10) Patent No.: US 11,242,644 B2
(45) Date of Patent: Feb. 8, 2022

(54) DOOR ASSEMBLY FOR A LAUNDRY TREATMENT MACHINE

(71) Applicant: Electrolux Appliances Aktiebolag, Stockholm (SE)

(72) Inventors: Danny Buso, Porcia (IT); Marco Santarossa, Porcia (IT); Luca Pradal, Porcia (IT); Dario Braconi, Porcia (IT)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 149 days.

(21) Appl. No.: 16/461,175

(22) PCT Filed: Oct. 18, 2017

(86) PCT No.: PCT/EP2017/076573

§ 371 (c)(1),
(2) Date: May 15, 2019

(87) PCT Pub. No.: WO2018/091219

PCT Pub. Date: May 24, 2018

(65) Prior Publication Data

US 2020/0063328 A1 Feb. 27, 2020

(30) Foreign Application Priority Data

Nov. 21, 2016 (EP) ..... 16199894

(51) Int. Cl.
*D06F 39/14* (2006.01)
*D06F 58/04* (2006.01)

(52) U.S. Cl.
CPC ..... *D06F 39/14* (2013.01); *D06F 58/04* (2013.01)

(58) Field of Classification Search
CPC ..... D06F 39/14; D06F 37/28; D06F 58/04; A47L 15/4257; A47L 15/4263–4265
See application file for complete search history.

(56) References Cited

U.S. PATENT DOCUMENTS

| | | | |
|---|---|---|---|
| 6,442,981 | B1 | 9/2002 | Augustsson |
| 6,966,204 | B2 | 11/2005 | Bollmann |
| 7,299,666 | B2 | 11/2007 | Geyer et al. |
| 7,320,186 | B2 | 1/2008 | Schöne |
| 7,340,924 | B2 | 3/2008 | Kim et al. |
| 7,363,781 | B2 | 4/2008 | Erickson |
| 7,398,662 | B2 | 7/2008 | Kim et al. |

(Continued)

FOREIGN PATENT DOCUMENTS

| | | |
|---|---|---|
| CN | 1888274 A | 1/2007 |
| DE | 202009005678 U1 | 6/2009 |

(Continued)

OTHER PUBLICATIONS

International Search Report and Written Opinion for International Application No. PCT/EP2017/076573, dated Jan. 22, 2018—9 pages.

*Primary Examiner* — Spencer E. Bell
*Assistant Examiner* — Omair Chaudhri
(74) *Attorney, Agent, or Firm* — RatnerPrestia

(57) ABSTRACT

A laundry treatment machine door assembly having a front frame and a cap element outwardly assembled to the front frame. The front frame and the cap element both comprise an irregularity which defines a handle for the door assembly.

15 Claims, 12 Drawing Sheets

(56) References Cited

U.S. PATENT DOCUMENTS

| | | | |
|---|---|---|---|
| 7,404,305 | B2 | 7/2008 | Kim et al. |
| 7,427,086 | B2 | 9/2008 | Park et al. |
| 7,478,502 | B2 | 1/2009 | Bienick et al. |
| D592,367 | S | 5/2009 | Crookshanks |
| 7,559,156 | B2 | 7/2009 | Renzo |
| 7,614,162 | B2 | 11/2009 | Renzo |
| 7,677,064 | B2 | 3/2010 | Kim et al. |
| 7,690,226 | B2 | 4/2010 | Son et al. |
| 7,694,537 | B2 | 4/2010 | Ha et al. |
| 7,698,910 | B2 | 4/2010 | Kim et al. |
| 7,716,957 | B2 | 5/2010 | Ha et al. |
| 7,735,346 | B2 | 6/2010 | Ha et al. |
| D622,918 | S | 8/2010 | Choi et al. |
| 7,802,855 | B2 | 9/2010 | Calmeise |
| 7,997,105 | B2 | 8/2011 | Hill et al. |
| 8,127,464 | B2 | 3/2012 | Schöne |
| 8,151,603 | B2 | 4/2012 | Kang et al. |
| 8,215,137 | B2 | 7/2012 | Ripley et al. |
| 8,448,482 | B2 | 5/2013 | Schuck et al. |
| 8,449,006 | B2 | 5/2013 | Joerger et al. |
| 8,459,065 | B2 | 6/2013 | Sung |
| 8,459,754 | B2 | 6/2013 | Cho et al. |
| 8,555,681 | B2 | 10/2013 | Caudevilla De sola et al. |
| 8,616,030 | B2 | 12/2013 | Hoppe et al. |
| 8,661,860 | B2 | 3/2014 | Murrell et al. |
| 8,844,328 | B2 | 9/2014 | Loss |
| 8,959,960 | B2 | 2/2015 | Hill et al. |
| 9,003,840 | B2 | 4/2015 | Pillot et al. |
| D730,602 | S | 5/2015 | Choi et al. |
| 9,045,849 | B2 | 6/2015 | Cevikkalp et al. |
| 9,115,461 | B2 | 8/2015 | Anderson et al. |
| 9,212,449 | B2 | 12/2015 | Fang et al. |
| 9,255,357 | B2 | 2/2016 | Bae et al. |
| 9,340,917 | B2 | 5/2016 | Carrillo |
| 9,441,395 | B2 | 9/2016 | Kim et al. |
| 9,487,901 | B2 | 11/2016 | Kim et al. |
| 9,790,637 | B2 | 10/2017 | Kim et al. |
| 9,909,248 | B2 | 3/2018 | Mora et al. |
| 9,926,728 | B2 | 3/2018 | Promutico et al. |
| 10,047,472 | B2 | 8/2018 | Park et al. |
| 10,053,810 | B2 | 8/2018 | Heo et al. |
| 10,060,066 | B2 | 8/2018 | Anand et al. |
| 10,094,063 | B2 | 10/2018 | Cheon et al. |
| 10,105,032 | B2 | 10/2018 | Wilson |
| 10,132,021 | B2 | 11/2018 | Harbrecht et al. |
| 10,145,053 | B2 | 12/2018 | Park |
| 10,161,076 | B2 | 12/2018 | Kwon et al. |
| 10,253,441 | B2 | 4/2019 | Anand et al. |
| 10,260,265 | B2 | 4/2019 | Heater |
| 10,267,073 | B2 | 4/2019 | Reichlyn |
| 10,294,712 | B2 | 5/2019 | Frantz et al. |
| 10,301,760 | B2 | 5/2019 | Kim et al. |
| 10,329,704 | B2 | 6/2019 | Harbrecht et al. |
| 10,351,988 | B2 | 7/2019 | Mora et al. |
| 10,415,174 | B2 | 9/2019 | Park et al. |
| 10,465,330 | B2 | 11/2019 | Tiggesbaeumker |
| 10,526,744 | B2 | 1/2020 | Park et al. |
| 10,563,340 | B2 | 2/2020 | Kim et al. |
| 10,590,590 | B2 | 3/2020 | Lee et al. |
| 10,612,296 | B2 | 4/2020 | Frantz et al. |
| 10,676,857 | B2 | 6/2020 | Heater |
| 10,683,597 | B2 | 6/2020 | Chen et al. |
| 2004/0083769 | A1 | 5/2004 | Kim et al. |
| 2004/0089031 | A1 | 5/2004 | Kim et al. |
| 2006/0260640 | A1 | 11/2006 | Son et al. |
| 2007/0256459 | A1 | 11/2007 | Yoon et al. |
| 2009/0165391 | A1 | 7/2009 | Kocak et al. |
| 2010/0175435 | A1* | 7/2010 | Shin ..... D06F 39/02 68/17 R |
| 2011/0023315 | A1 | 2/2011 | Schöne |
| 2011/0023559 | A1 | 2/2011 | Schöne |
| 2011/0025178 | A1 | 2/2011 | Schöne |
| 2012/0007482 | A1* | 1/2012 | Pillot ..... D06F 37/28 312/228 |
| 2012/0086315 | A1* | 4/2012 | Da Riol ..... D06F 39/14 312/228 |
| 2013/0232810 | A1 | 9/2013 | Coxon et al. |
| 2014/0157676 | A1* | 6/2014 | Kim ..... D06F 37/28 49/394 |
| 2015/0003027 | A1* | 1/2015 | Han ..... H05K 7/1427 361/752 |
| 2015/0233041 | A1 | 8/2015 | Batur et al. |
| 2016/0273149 | A1* | 9/2016 | Jo ..... D06F 34/20 |
| 2016/0340820 | A1* | 11/2016 | Kim ..... D06F 39/14 |
| 2017/0260678 | A1* | 9/2017 | Wee ..... D06F 37/266 |
| 2017/0306547 | A1 | 10/2017 | Wang |
| 2018/0140162 | A1 | 5/2018 | Citak et al. |
| 2018/0153370 | A1 | 6/2018 | Lang et al. |
| 2018/0163333 | A1* | 6/2018 | Zhang ..... D06F 37/28 |
| 2018/0340286 | A1* | 11/2018 | Kim ..... D06F 37/26 |
| 2018/0363193 | A1 | 12/2018 | Gim |
| 2018/0363200 | A1 | 12/2018 | Gim |
| 2018/0363203 | A1 | 12/2018 | Gim |
| 2018/0363204 | A1 | 12/2018 | Gim |
| 2018/0363205 | A1 | 12/2018 | Lee |
| 2018/0363206 | A1 | 12/2018 | Lee |
| 2018/0363224 | A1 | 12/2018 | Lee |
| 2018/0363225 | A1 | 12/2018 | Lee |
| 2019/0003106 | A1 | 1/2019 | Lee et al. |
| 2019/0010650 | A1 | 1/2019 | Xu et al. |
| 2019/0063123 | A1 | 2/2019 | Ham et al. |
| 2019/0112746 | A1 | 4/2019 | Chi et al. |
| 2019/0330785 | A1 | 10/2019 | Han et al. |
| 2020/0032443 | A1 | 1/2020 | Ekbundit |
| 2020/0063327 | A1 | 2/2020 | Byun |
| 2020/0063328 | A1 | 2/2020 | Buso et al. |
| 2020/0131691 | A1 | 4/2020 | Park et al. |
| 2020/0157728 | A1 | 5/2020 | Bodine et al. |
| 2020/0165764 | A1 | 5/2020 | You et al. |
| 2020/0165767 | A1 | 5/2020 | You et al. |

FOREIGN PATENT DOCUMENTS

| | | | | |
|---|---|---|---|---|
| DE | 102008044336 | B3 * | 1/2010 | ..... D06F 39/14 |
| EP | 0870861 | A1 | 10/1998 | |
| EP | 1609902 | A2 | 12/2005 | |
| EP | 2402499 | B1 * | 4/2014 | ..... D06F 39/14 |
| EP | 2938773 | B1 | 11/2015 | |
| EP | 2987903 | A2 | 2/2016 | |
| WO | 2003004754 | A1 | 1/2003 | |
| WO | 2006080788 | A1 | 8/2006 | |
| WO | 2011012589 | A1 | 2/2011 | |
| WO | 2015021723 | A1 | 2/2015 | |
| WO | 2016036021 | A1 | 3/2016 | |

* cited by examiner

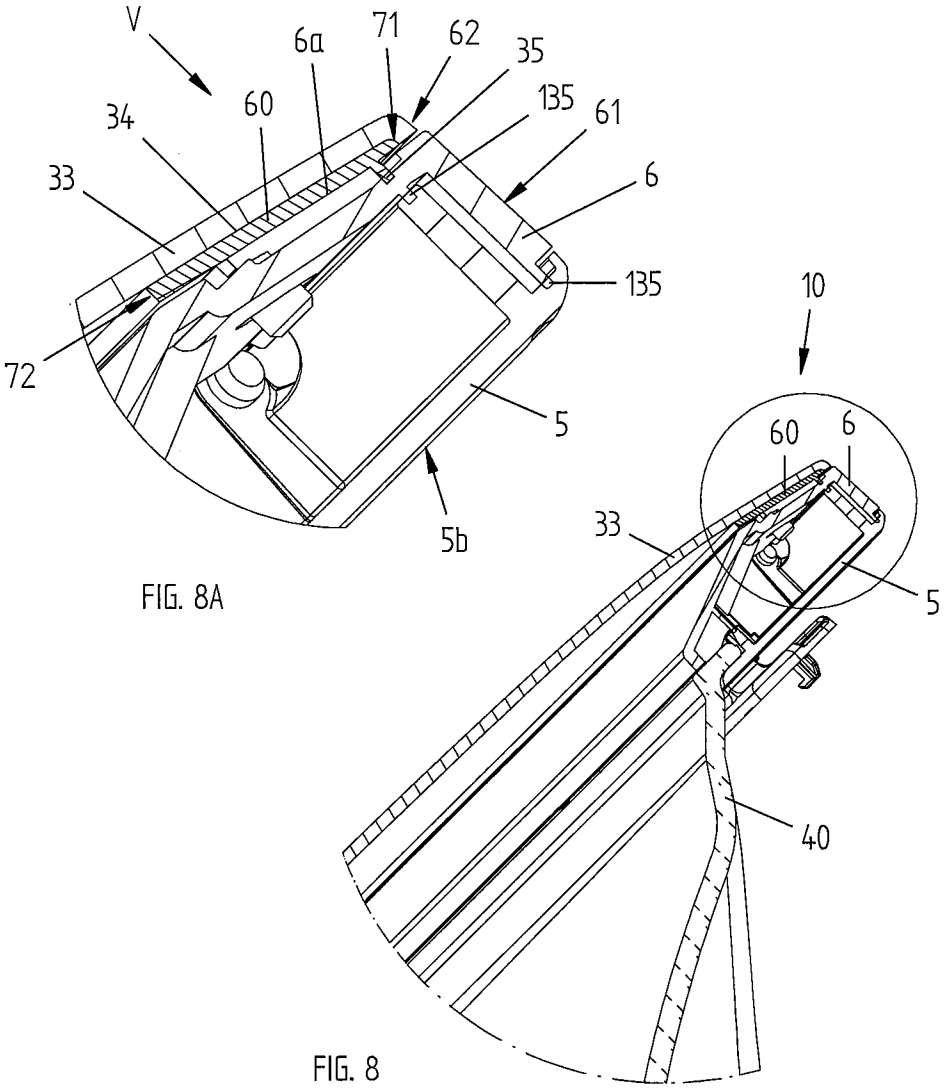
FIG. 8A
FIG. 8
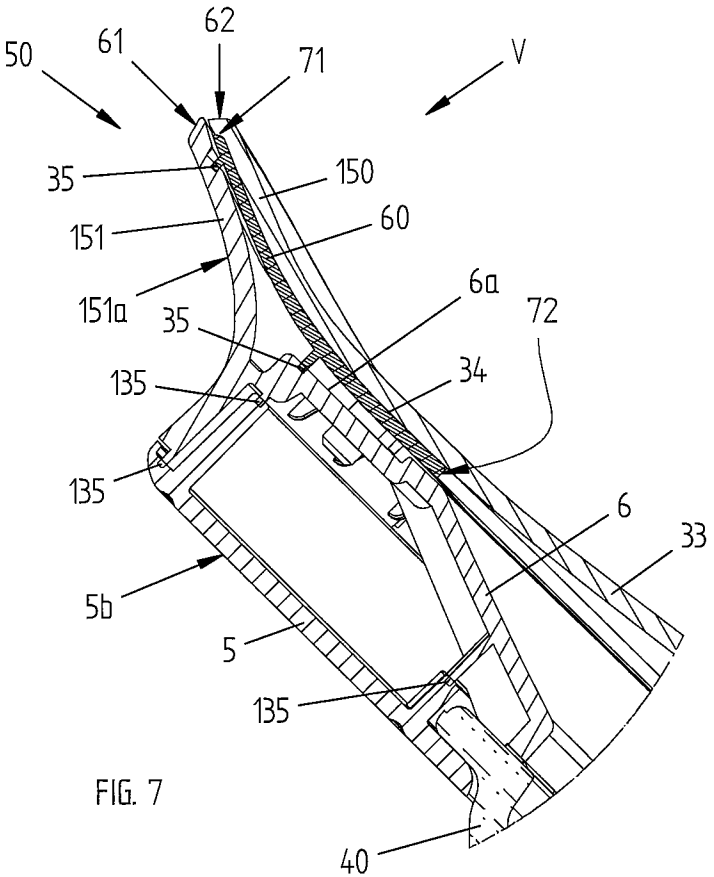
FIG. 7

DOOR ASSEMBLY FOR A LAUNDRY TREATMENT MACHINE

This application is a U.S. National Phase application of PCT International Application No. PCT/EP2017/076573, filed Oct. 18, 2017, which claims the benefit of EP 16199894.3, filed Nov. 21, 2016, both of which are incorporated by reference herein.

TECHNICAL FIELD

The present invention relates to a doer assembly for a laundry treatment machine, in particular for a washing machine, a dryer or a washer-dryer.

The door assembly is so construed to have an appealing aesthetic appearance and to minimize the number and type of parts for manufacturing and installing such door assembly.

BACKGROUND ART

Conventionally, laundry treatment machines include a casing within which a laundry treatment chamber, such as a drum, is located. In the casing, more in particular in a front wall of the same, an opening is made, which gives access to the treatment chamber to load or unload the laundry before and after the washing and/or drying cycle(s).

A door assembly, also called porthole, is rotatably fixed, for example hinged, to the casing and it is apt to open and close the mentioned opening.

Door assemblies of known types typically comprise a front frame forming a front surface of the door assembly and a rear frame forming a rear surface of the door assembly. A closure element, typically a glass, is interposed between the rear frame and the front frame.

It is also known that door assemblies of known type are advantageously equipped with a handle facilitating opening and/or closing of the door.

According to a first assembly of known type, a handle-carrying element is typically interposed between the rear frame and the front frame and a handle is carried by said handle-carrying element.

According to a different assembly of known type, the handle is carried directly by the rear frame.

A first drawback posed by the known assemblies is constituted by the fact that they are composed by a great number of pieces.

This determines a complex structural construction for the assembly which increases the manufacturing costs of the assembly and of the laundry treatment machine.

It is also known that the aesthetic appearance of the laundry treatment machine is important and represents a characteristic that might determine the machine's choice by the user. Among the preferred aesthetic characteristics, a smooth, even and glossy door assembly is particularly important.

It is clear that the arrangement of the handle inevitably affects the aesthetic appearance of the door assembly.

It follows that a further drawback posed by the known assemblies is constituted by the fact that the handle may negatively affects aesthetic appearance of the door assembly and hence of the laundry treatment machine.

The object of the present invention is therefore to overcome the drawbacks posed by the known techniques.

It is a first object of the invention to implement a laundry treatment machine that makes it possible to reduce manufacturing time and costs.

It is a further object of the invention to implement a laundry treatment machine equipped with a door assembly which is more user-friendly compared to known systems.

It is a further object of the invention to implement a laundry treatment machine equipped with a door assembly having improved aesthetic appearance compared to known systems.

DISCLOSURE OF INVENTION

The applicant has found that by providing a door assembly for a laundry treatment machine comprising a front frame and a cap element outwardly assembled to said front frame wherein said front frame and the cap element both comprise an irregularity which defines a handle for the door assembly, it is possible to overcome drawbacks of known techniques.

The present invention relates, therefore, to a door assembly for a laundry treatment machine, apt to open and/or close an opening defined in said laundry treatment machine, said door assembly comprising a front frame and a cap element outwardly assembled to said front frame, said cap element forming the front surface of said door assembly, wherein said front frame has an outer edge comprising an irregularity and said cap element has an outer edge comprising an irregularity, wherein said irregularities define a handle for said door assembly.

Preferably the cap element is outwardly supported by the front frame and fixed thereto.

In a preferred embodiment of the invention, the outer edge of the front frame follows the outer edge of the cap element.

According to a preferred embodiment of the invention, the cap element is at least partially transparent and comprises an inner side facing the front frame, wherein an opaque element is arranged at the inner side of the cap element and between the front frame and the cap element.

Preferably the opaque element comprises an outer edge which borders the outer edge of said cap element and borders the outer edge of the front frame.

In a preferred embodiment of the invention, the opaque element is ring-shaped.

Preferably, the opaque element comprises an inner edge defining an aperture.

According to a preferred embodiment of the invention, the front frame comprises a front side and the opaque element overlaps a peripheral zone of the front side of the front frame when viewed laterally outwardly from the door assembly.

With the action "viewed laterally outwardly" is intended as the view of the door, frontally to the front surface of the door assembly, preferably in a parallel direction with respect to a door assembly central axis.

In a preferred embodiment of the invention, the front frame comprises at least an aperture apt to receive a portion of a hinge device of the door assembly. More preferably, the front frame comprises at least an aperture apt to receive a portion of a hinge device of the door assembly when the door assembly is in a closed position.

Preferably the door assembly further comprises a rear frame and a closing element arranged between the rear frame and the front frame, wherein the rear frame, the closing element and the front frame are assembled together.

In a preferred embodiment of the invention, the closing element is at least partially transparent.

According to a preferred embodiment of the invention, the rear frame and the front frame are assembled together via suitable fastening means, preferably by means of welding, screws, snap device.

Preferably the cap element peripherally extends beyond the front frame and or the opaque element so that a peripheral zone of the front frame is visible when viewed laterally outwardly from the door assembly.

In a preferred embodiment of the invention, the irregularity comprises a radial protrusion and/or a bulge.

Preferably, the protrusion comprises a portion of the outer edge that locally extends in a circular path around the door assembly central axis at a distance greater than the distance of adjacent outer edge portions.

Preferably, the door assembly is a pull to open door assembly.

According to the invention, the handle is fixed and does not perform any movement relative to the front frame.

In a preferred embodiment of the invention, the cap element is a closed element.

According to a preferred embodiment of the invention, the handle is defined only by the front frame and the cap element.

The present invention further relates to a laundry treatment machine comprising a casing including a wall on which an opening is formed and comprising a door assembly realized as described above, the door assembly being apt to open and/or close said opening.

BRIEF DESCRIPTION OF THE DRAWINGS

Further characteristics and advantages of the present invention will be highlighted in greater detail in the following detailed description of preferred embodiments of the invention, provided with reference to the enclosed drawings. In the drawings, corresponding characteristics and/or components are identified by the same reference numbers. In such drawings:

FIG. 7 shows a partial view of the door assembly of FIG. 6 sectioned along line VII°-VII°;

FIG. 8 shows a partial view of the door assembly of FIG. 6 sectioned along line VIII°-VIII°;

FIG. 8A shows an enlarged view of a detail of FIG. 8;

DETAILED DESCRIPTION OF THE INVENTION

The present invention has proved to be particularly advantageous when applied to laundry washing machines, as described below. It should in any case be underlined that the present invention is not limited to laundry washing machines. On the contrary, the present invention can be conveniently applied to dryers or washer-dryers (i.e. laundry washing machines which can also dry laundry).

Figure 1:
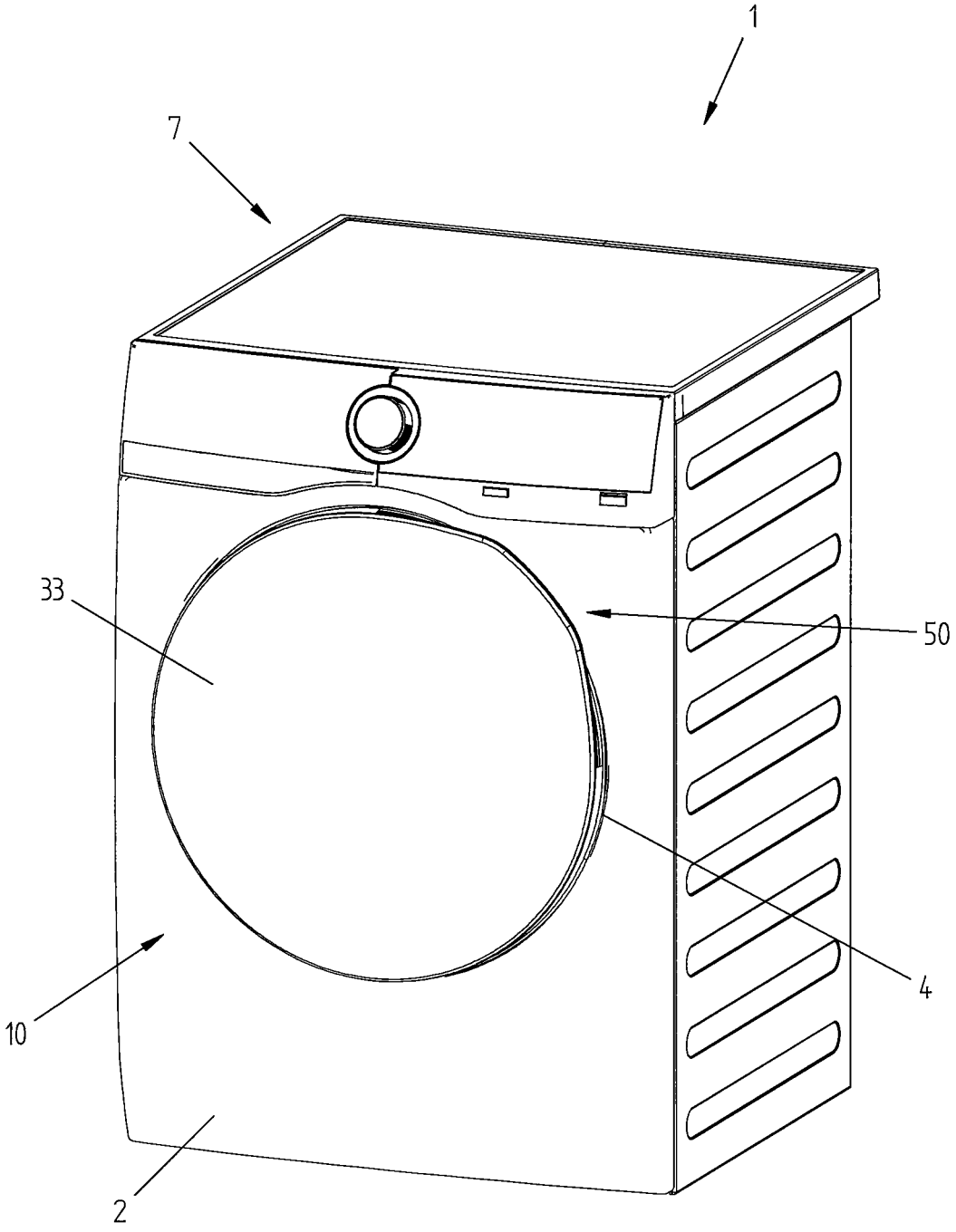
FIG. 1 shows a perspective view of a preferred embodiment of a laundry treatment machine realized according to the present invention.
Figure 3:
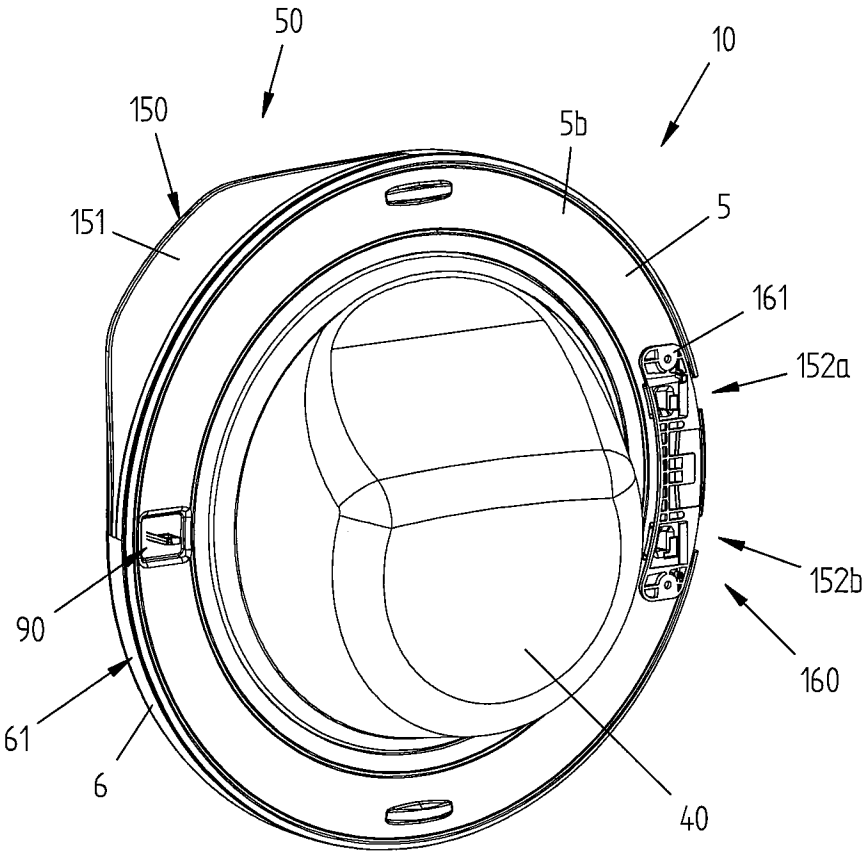
FIG. 3 shows the door assembly of FIG. 2 from another point of view.

With reference to FIG. 1 an embodiment of a laundry treatment machine realized according to the present invention is globally indicated with 1. In this preferred embodiment, the laundry treatment machine 1 is a laundry washing machine, however the present teaching can be applied to dryers and washer-dryers as well.

The laundry washing machine 1 comprises an outer box casing 7 preferably but not necessarily parallelepiped-shaped, and a treatment chamber, such as a drum (not visible in the Figure), for example having the shape of a hollow cylinder, for housing the laundry and in general the clothes and garments to be washed and/or dried.

The drum is preferably contained into the casing 7. In a preferred embodiment, drum can rotate around a preferably horizontal axis (in alternative embodiments, rotation axis may be vertical or tilted).

Access to the drum is achieved for example via an opening 4 formed on the casing 7 itself. Opening 4 preferably faces drum and it is apt to be closed—or even sealed—by a door assembly 10.

The door assembly 10 is adapted to alternatively open and close the laundry loading opening 4 of the laundry washing machine 1 and is advantageously pivotally mounted, for example hinged, and thus supported at the casing 7 of the machine 1. Door assembly 10 can be preferably operated by a handle 50, as better detailed below.

Preferably, casing 7 generally includes a front wall 2 to which the door assembly 10 is pivotally mounted.

The door assembly 10 can have two different operative positions or configurations: a closed position in which it is abutting against the front wall 2 and an open position in which is separated from the front wall 2, with the exception of the connecting element (e.g. hinge) location. In order to move the door assembly 10 from the closed to the open configuration or vice-versa, handle 50 is used.

Handle 50 preferably belongs to a system which may be named "pull-to-open" door opening system: the door assembly 10 is provided with a latch 90 and the casing 7, preferably front wall 2, is provided with a latch retaining mechanism that includes a mobile part which is configured to be movable between a retaining position, in which it engages the latch 90 so as to retain the door assembly 10 in the closed condition, and an opening position in which it releases the latch 90 so as to allow the opening of the door assembly 10. The mobile part of the latch allows the releasing of the latch when a releasing force is applied which is greater than a threshold force. The door assembly 10 is therefore opened by pulling it outwards with enough force and can be closed by pushing it towards the inside of the treatment chamber with enough force too.

With reference to FIGS. 2, 3, 9 and 10, the door assembly 10 preferably comprises a rear frame 5, a front frame 6 and a closing element 40, more preferably a transparent closing element, arranged between the rear frame 5 and the front frame 6.

The wording "rear frame" 5 is indicating in the following as the portion of the door assembly 10 a side of which, called rear side 5*b*. is substantially in contact with, or immediately in front of, the casing 7 when the door assembly 10 is in the closed operative position, while the front frame 6 is defined as the portion of the door assembly 10 arranged outwardly when the door assembly 10 is closed onto casing 7, i.e. it faces a direction opposite to the casing 7.

Preferably, the front frame 6 further comprises a front side 6*a* and a rear side 6*b*, the latter being apt to be in contact with or facing the rear frame 5 when the door assembly 10 is in an assembled configuration.

The front side 6*a* of the front frame 6 represents, preferably, the surface which is arranged most outwardly with respect to the casing 7 for the front frame 6 itself.

Analogously, rear frame 5 comprises a front side 5*a* which is apt to be in contact with or facing the rear side 6*b* of from frame 6 when the door assembly 10 is in an assembled configuration, and it is also opposite to rear side 5*b*.

The rear frame 5 preferably comprises a rear aperture 8 and the front frame 6 preferably comprises a front aperture 9.

The presence of said apertures 8, 9 is preferred when the laundry treatment machine 1 is a laundry washing machine so that a user can view the laundry when viewed laterally outwardly from the door assembly 10, i.e. from outside the casing 7, during the treatment cycles.

Rear and front frames 5, 6 are therefore so mounted that the two apertures 8, 9 overlap, at least partially.

Preferably, rear and front frames 5, 6 are coaxial and/or concentric. Analogously, preferably, apertures 8, 9 are coaxial and/or concentric.

Preferably, rear and front frames 5, 6 and rear and front apertures 8, 9 of door assembly 10, have an arbitrary geometrical shape, for example can be substantially polygonal, such as rectangular, quadratic, triangular, or elliptic when a front view of the same is considered.

Preferably, rear and front frames 5, 6 and rear and front apertures 8, 9 are circular, or substantially circular.

In the preferred embodiment of door assembly 10, the rear aperture 8 in the rear frame 5 is closed by the closing element 40.

The closing element 40 is preferably a glass and preferably has a bowl shape.

In different embodiments, the closing element may be differently shaped and made of different material, for example a plate-shaped element and/or made of plastic or metal.

Preferably, rear and front frame 5, 6 are made of plastic, more preferably each of them is formed as an integral piece of plastic, for example by injection molding.

As better visible in figures, front and rear frame 6, 5 of door assembly 10 are preferably ring shaped, so as to form a substantially round-shaped door assembly 10, when connected one to the other.

The rear frame 5 and the front frame 6 are preferably reciprocally assembled one to the other by means of a fastening device. In the preferred embodiment illustrated in the figures, the fastening device preferably comprises welding. At this purpose, the front frame 6 at the rear side 6*b* thereof comprises ribs 135, facing the rear frame 5, the ends of which allow welding of the front frame 6 to the rear frame 5, for example through ultrasonic welding.

In further preferred embodiments of the invention, the fastening device may be of different type, for example screws, snap devices, etc.

The closing element 40 is preferably sandwiched between the rear frame 5 and the front frame 6 and kept firmly in position therebetween. In the preferred embodiment illustrated in the figures, no one fastening device is used.

In further preferred embodiments of the invention, fastening devices may be provided for the fixing of the closing element to the rear frame and/or to the front frame, such as welding, screws, snap devices, etc.

According to an aspect of the present invention, the door assembly 10 preferably comprises a cap element 33 outwardly assembled to said front frame 6. More preferably, the cap element 33 is outwardly supported by the front frame 6 and fixed thereto.

The cap element 33 is preferably a dosed element, i.e. it does not comprise any aperture.

The front frame 6 comprises an outer edge 61 and the cap element 33 comprises an outer edge 62.

Preferably, outer edge 62 of the cap element 33 follows outer edge 61 of the from frame 6. Outer edge 62 of the cap element 33 and outer edge 61 of the front frame 6 defines the outer contour of the door assembly 10.

According to an aspect of the present invention, the cap element 33 and the from frame 6 preferably comprise an irregularity 150, 151 which defines the handle 50 for the door assembly 10. More preferably, an irregularity 150 is defined on the outer edge 62 of the cap element 33 and an irregularity 151 is defined on the outer edge 61 of the front frame 6. Said irregularities 150, 151 both define the handle 50 for the door assembly 10.

In the preferred embodiment illustrated and described herewith said irregularity 150 of the outer edge 62 of the cap element 33 preferably comprises a portion of the outer edge 62 which projects from the regular contour RC of the cap element 33, or radial protrusion.

Figure 2:
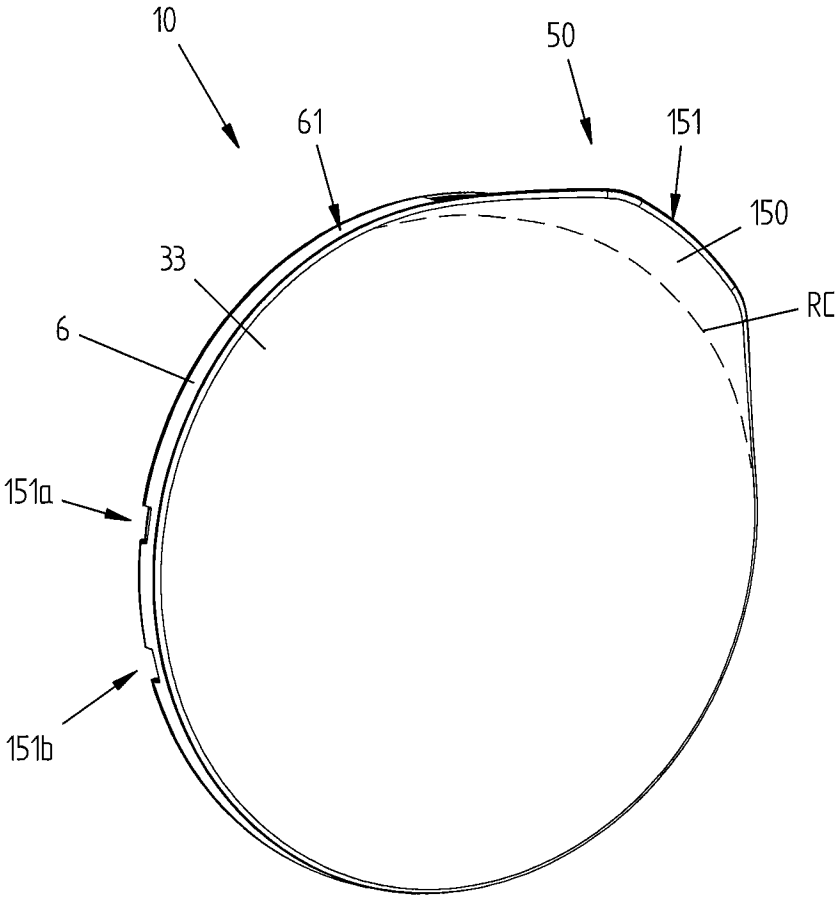
FIG. 2 shows a perspective view of a door assembly realized according to the present invention and used in the laundry treatment machine of FIG. 1.
Figure 5:
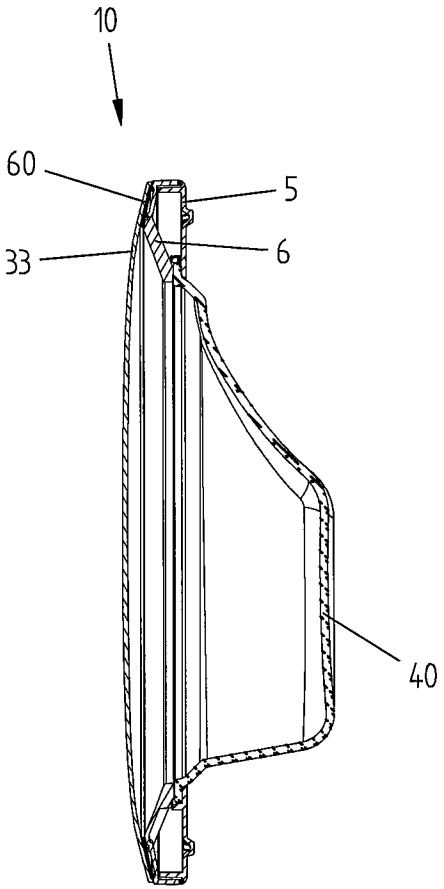
FIG. 5 shows the door assembly of FIG. 4 sectioned along line V°-V°.
Figure 4:
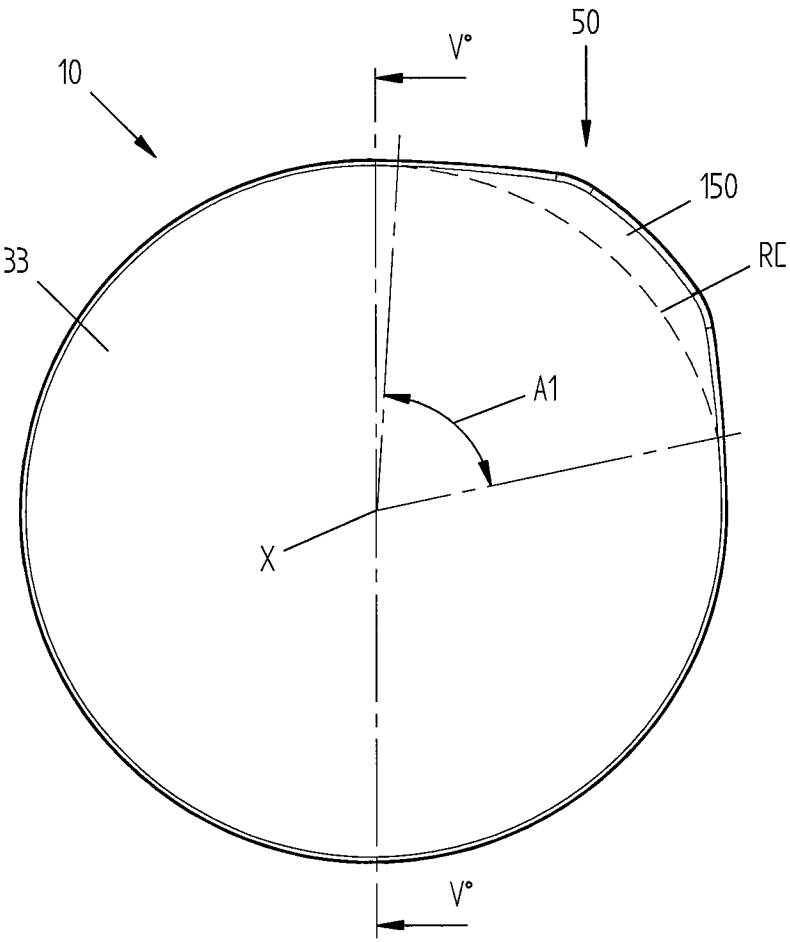
FIG. 4 shows a front plan view of the door assembly of FIG. 2.
Figure 6:
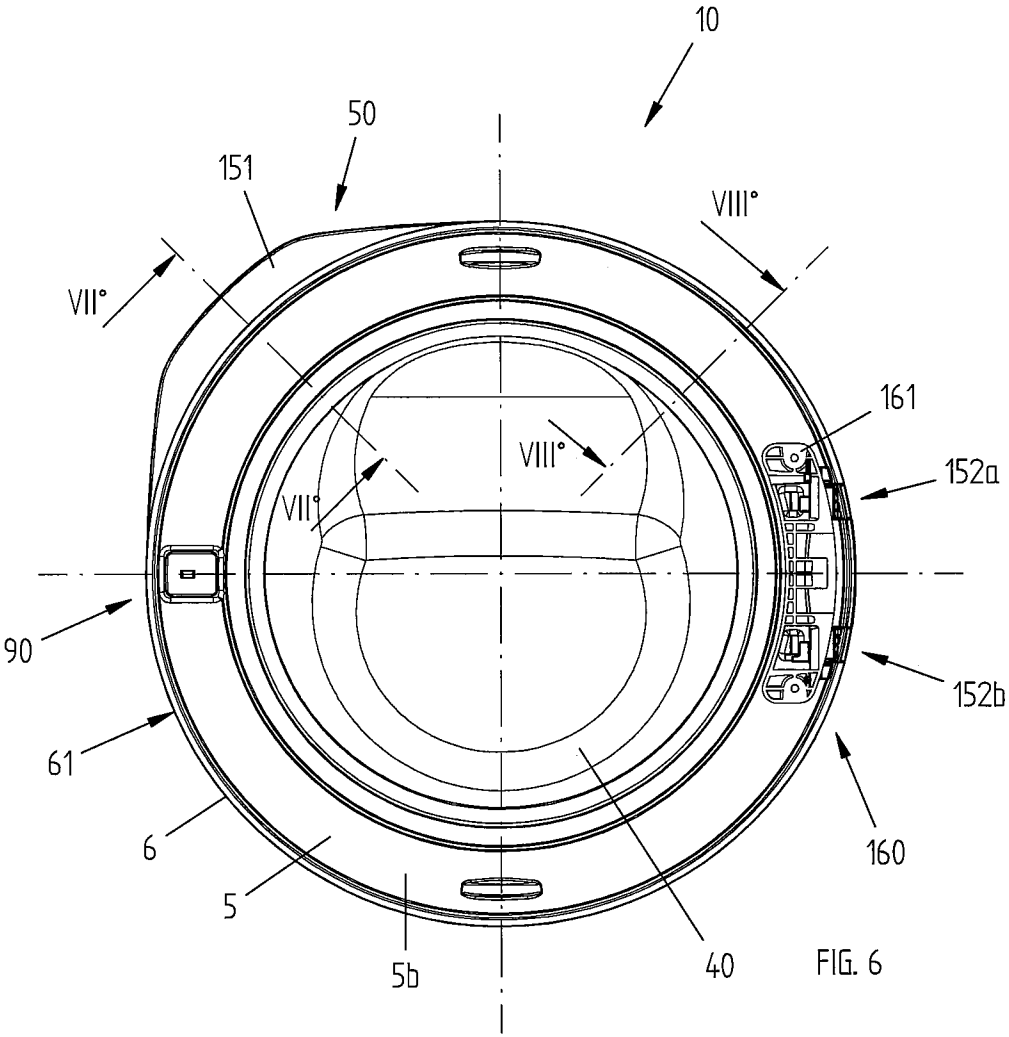
FIG. 6 shows a plan view of the door assembly of FIG. 3.
Figure 9:
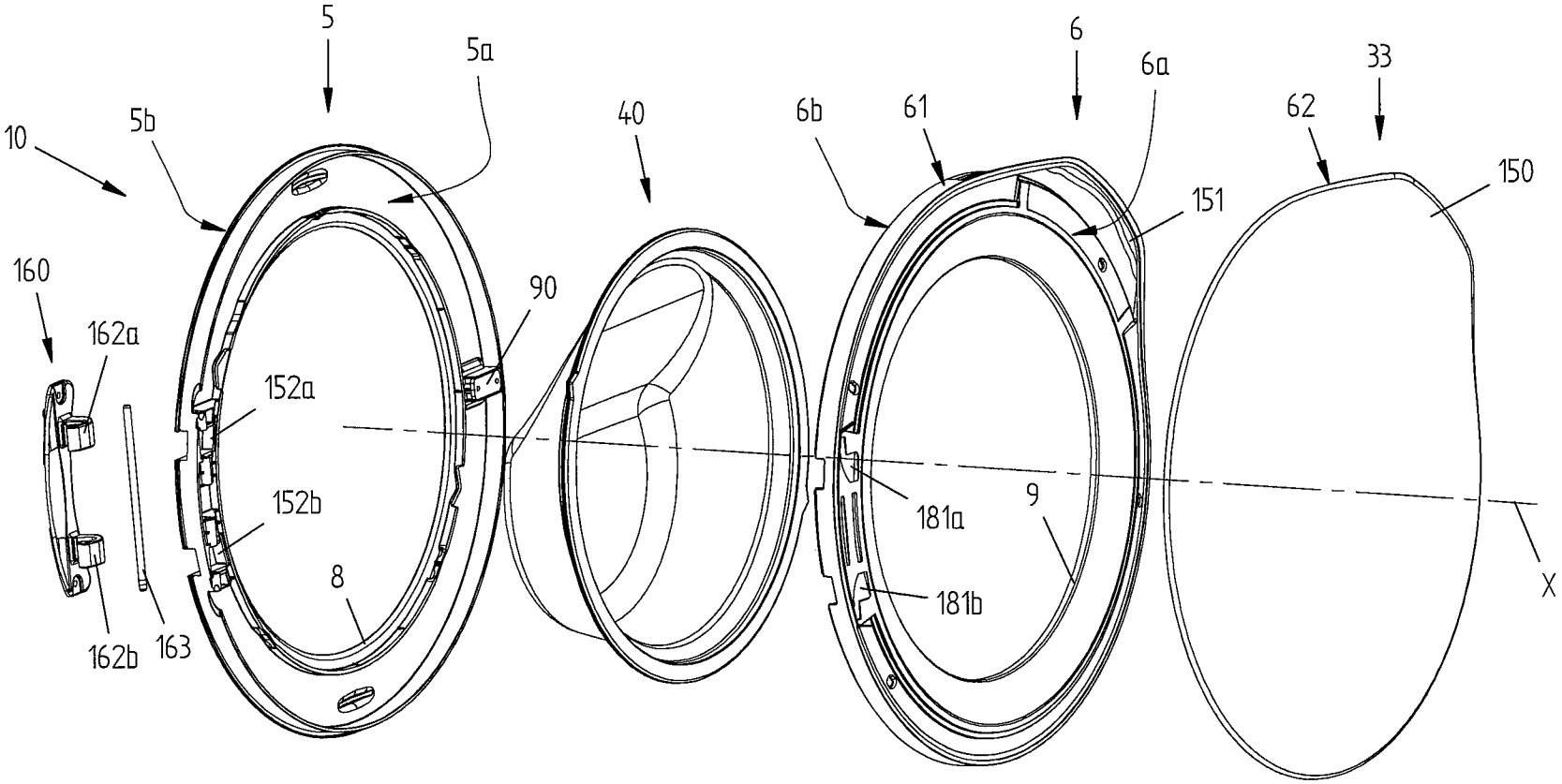
FIG. 9 shows the door assembly of FIG. 2 in a disassembled configuration.
Figure 10:
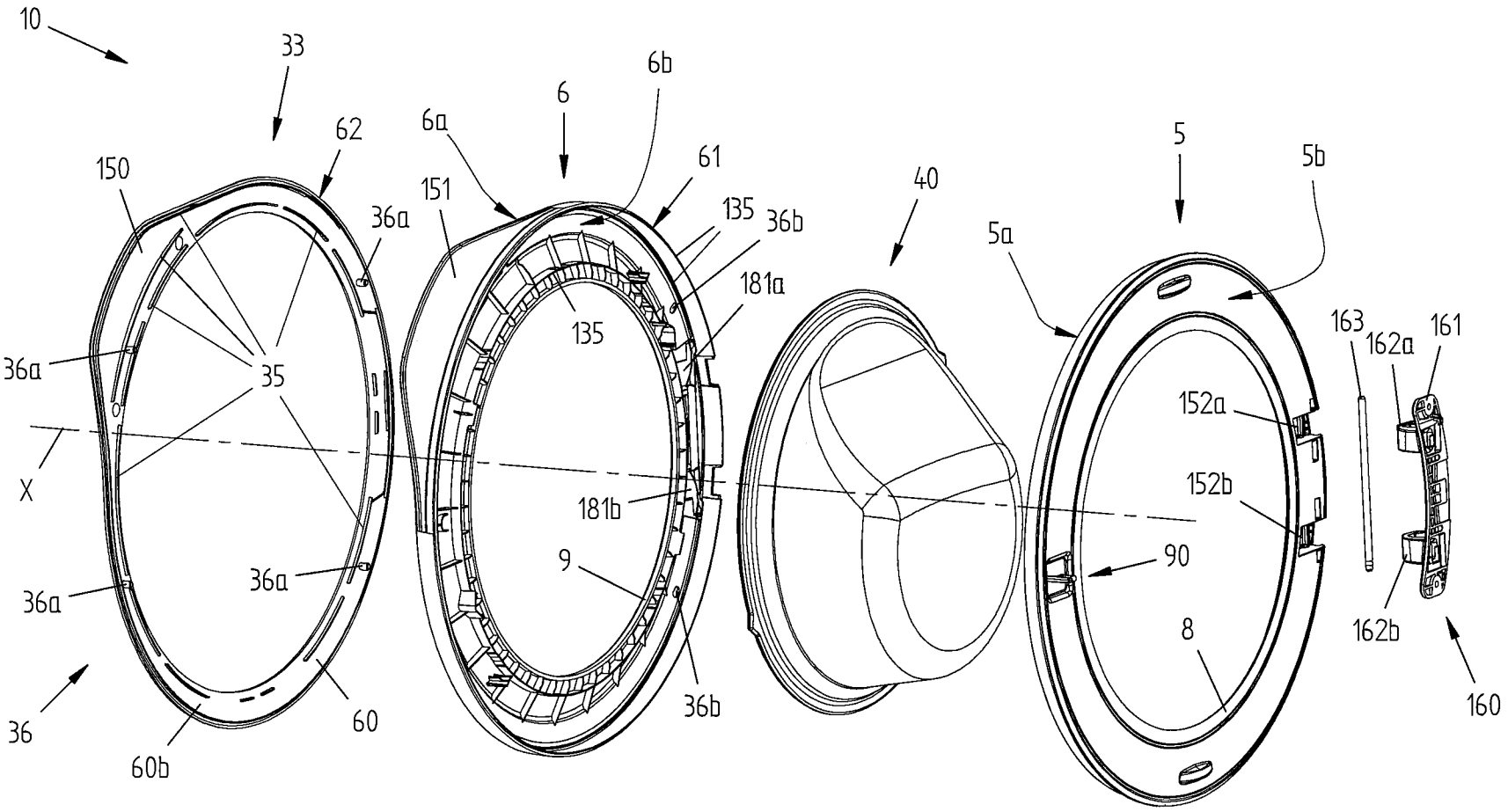
FIG. 10 shows the door assembly in the disassembled configuration of FIG. 9 from another point of view.

FIGS. 2 and 4 show the projecting portion 150, wherein the regular contour of the cap element 33 is indicated with a dashed line RC.

In the preferred embodiment here illustrated, the regular contour RC is preferably a circumference and the projecting portion 150 is substantially preferably defined by an annular rim portion.

Preferably, therefore, the projecting portion 150 comprises a portion of the outer edge 62 that locally extends in a circular path around the door assembly central axis X at a distance greater than the distance of adjacent outer edge portions.

Preferably the annular rim portion extends over an angle A1 of about 90°.

Figure 14:
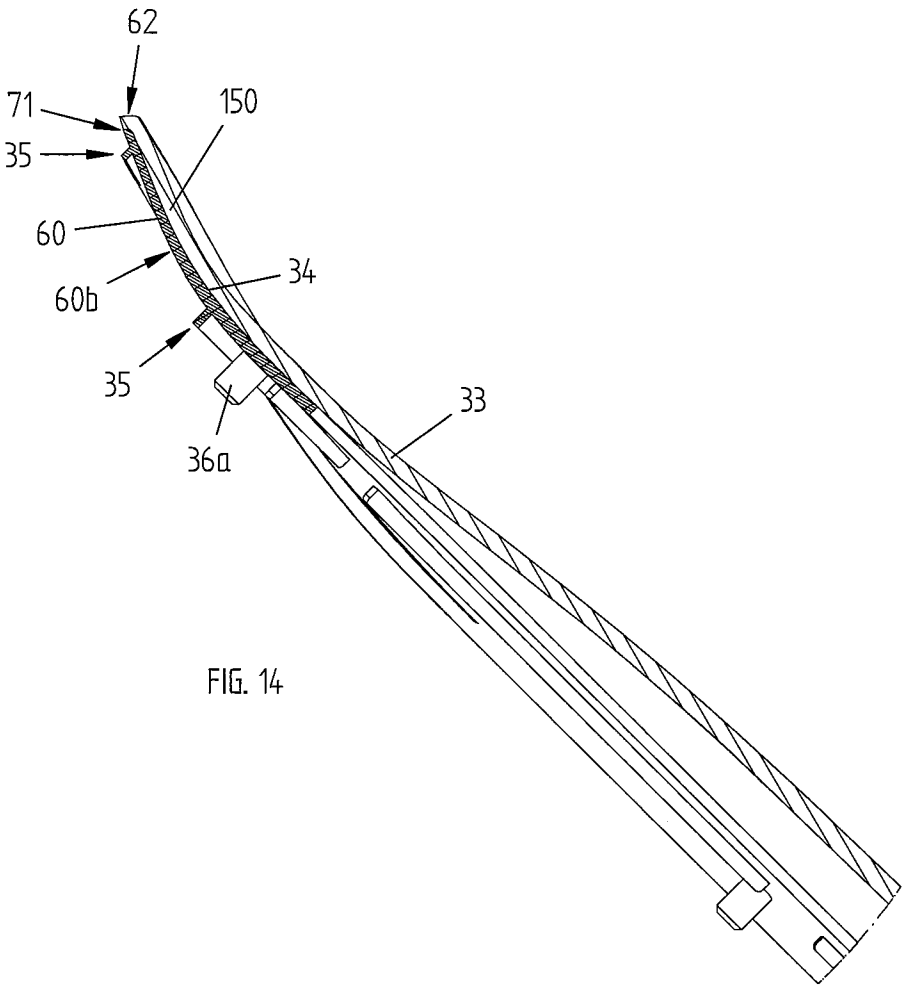
FIG. 14 shows a partial view of the door assembly of FIG. 13 sectioned along line XIV°-XIV°.
Figure 16:
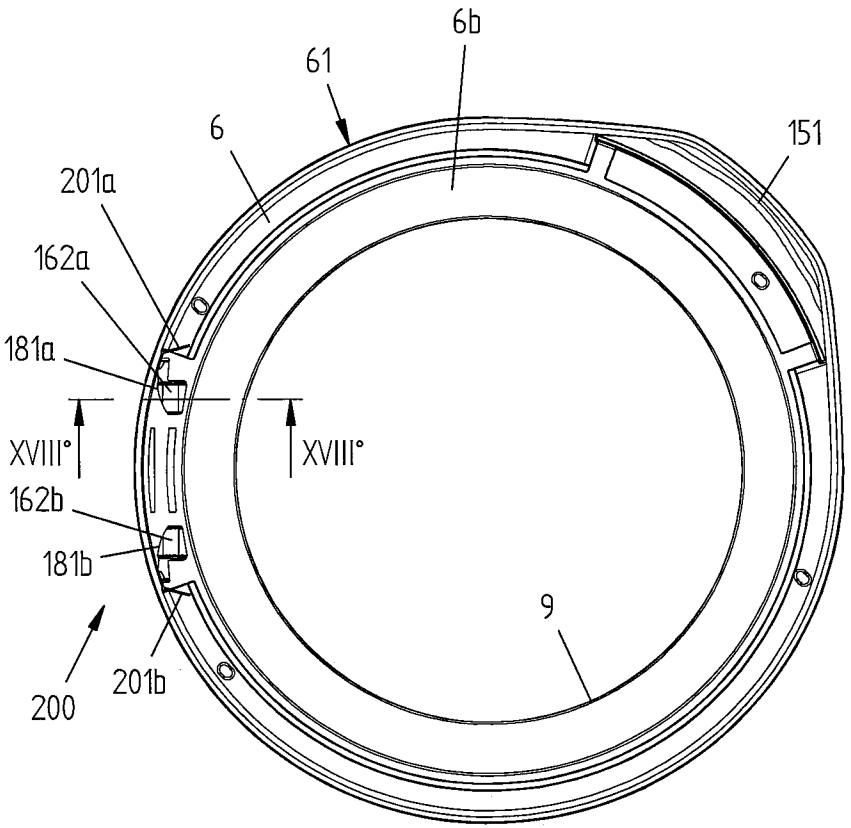
FIG. 16 shows some components of FIG. 10 in an assembled configuration.

The projecting portion 150 is preferably inclined towards the outside, i.e. towards the external of the laundry washing machine 1, so as to define a bulge. Inclination of the projecting portion 150 is better visible in FIGS. 7 and 14. In other words, the projecting portion 150 is preferably outwardly inclined in the direction from the front frame 6 to the cap element 33.

Analogously, in the preferred embodiment illustrated and described herewith said irregularity 151 of the outer edge 61 of the front frame 6 preferably comprises a portion of the outer edge 61 which projects from the regular contour of the front frame 6, or radial protrusion.

Figure 12:
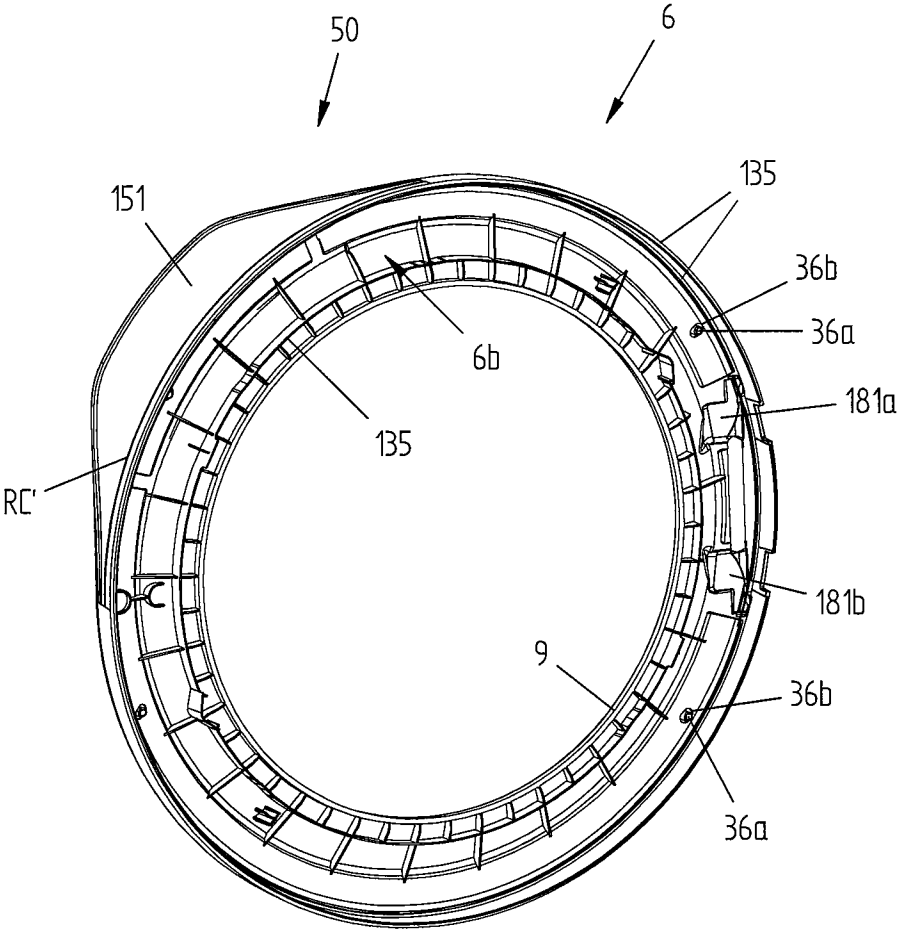
FIG. 12 shows the components of FIG. 11 from another point of view.
Figure 11:
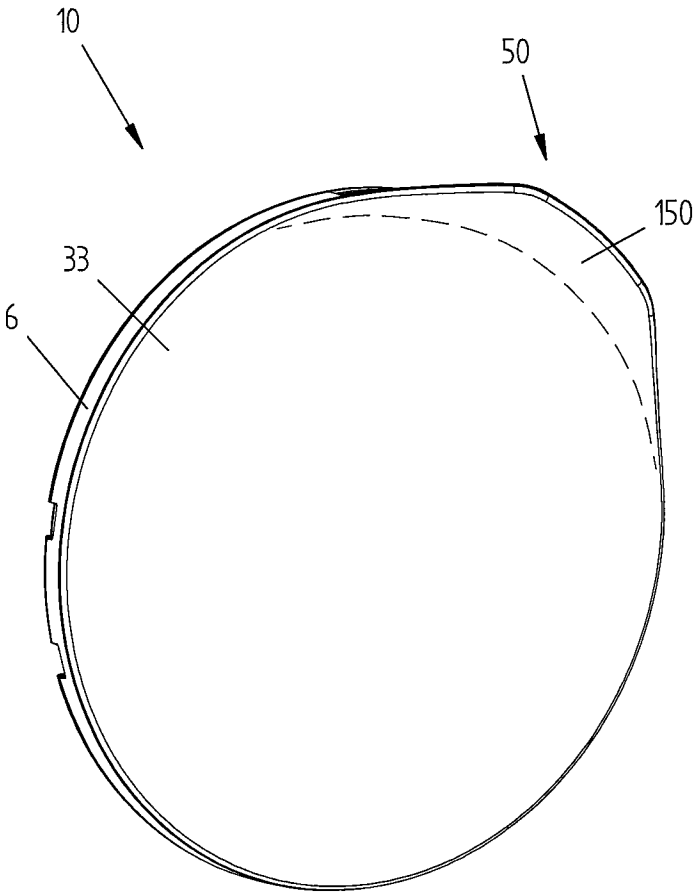
FIG. 11 shows two components of FIG. 10 in an assembled configuration.

FIG. 12 shows the projecting portion 151, wherein also the regular contour RC' of the front frame 6 is depicted.

In the preferred embodiment here illustrated, the regular contour RC' is preferably a circumference and the projecting portion 51 is substantially preferably defined by an annular rim portion. Preferably the annular rim portion extends over the same angle A1 (of about 90°) of the annular rim portion 150 of the cap element 33.

The projecting portion 151 is preferably inclined towards the outside, i.e. towards the external of the laundry washing machine 1, so as to define a bulge. Inclination of projecting portion 151 is better visible in FIG. 7. In other words, the projecting portion 151 is preferably outwardly inclined in the direction from the rear frame 5 to the front frame 6. The inner side 151*a* of projecting portion 151 preferably defines the gripping portion for the finger's user.

Irregularity 150 of the cap element 33 and irregularity 151 of the front frame 6 which define said handle 50, as described above, are preferably defined by both a radial protrusion and a bulge.

In different embodiments, nevertheless, the irregularity may be defined only by a radial protrusion or only by a bulge. For example, in further preferred embodiments the cap element and the front frame could be substantially flat with radial protrusions defining the handle or in further preferred embodiments the cap element and the front frame could be circular with bulges defining the handle.

Preferably, when assembled, the handle 50 is fixed, e.g. it does not operate directly any mechanism to open and/or close the door assembly 10, being the system of the "pull-to-open" type. The handle 50, during opening and/or closing movement, preferably does not perform any movement relative to the rear and/or front frame 5, 6.

Preferably, according to the description above, the front frame 6 and the cap element 33 are the only elements which define the handle 50 or, in other words, the handle 50 is defined only by the front frame 6 and the cap element 33 of the door assembly 10.

Realization of the handle 50 as described above allows to reduce the complexity of the door assembly 10 and therefore of the laundry washing machine 1.

This determines a simple structural construction for the assembly which reduces manufacturing costs of the assembly and of the laundry treatment machine compared to known systems.

Furthermore, the door assembly 10 according to the invention is smooth, even and glossy compared to known assemblies.

Preferably, the cap element 33 is at least partially transparent.

Transparency allows light to pass through the cap element 33 so that bodies situated behind can be seen. Preferably, therefore, the closing element 40 which is typically made of glass can be seen through the cap element 33 and hence also the inner of the drum where the laundry is placed can be seen.

The cap element 33, apart from maintaining its at least partial transparency, may also comprises further aesthetic characteristics, such as coloured areas, images, areas with different degree of transparency, etc.

According to a further preferred aspect of the present invention, an opaque element 60 is arranged between the front frame 6 and the cap element 33.

Opacity does not allow light to pass through so that it is difficult, or impossible, to see through or reduces the passage of the most part of incident light so that it is difficult, or impossible, to see through.

Preferably, the cap element 33 comprises a first side 34, or inner side, facing the front frame 6 and the opaque element 60 is fixed to the inner side 34 of the cap element 33, as depicted in FIGS. 7 and 8A.

Figure 13:
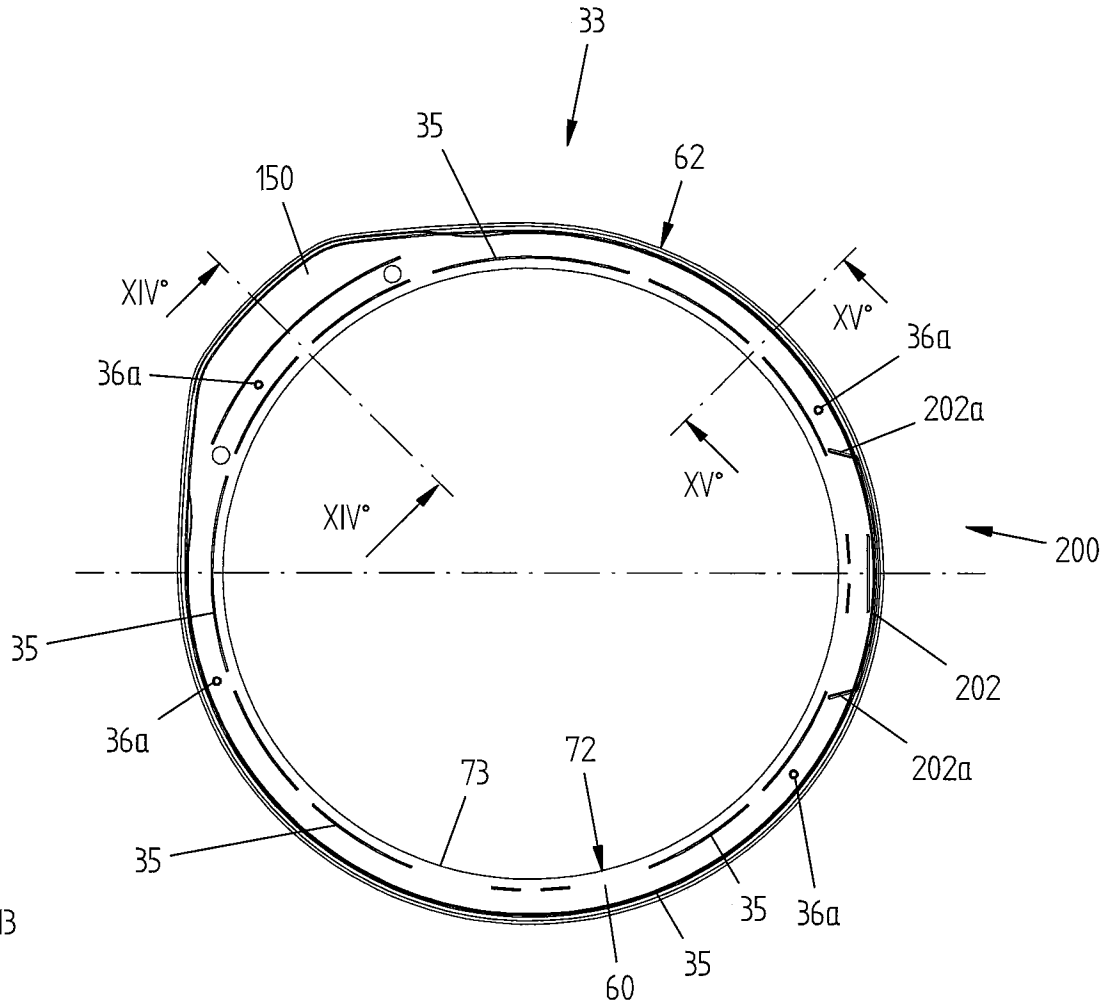
FIG. 13 is a side plan view of a component of FIG. 10.
Figure 15:
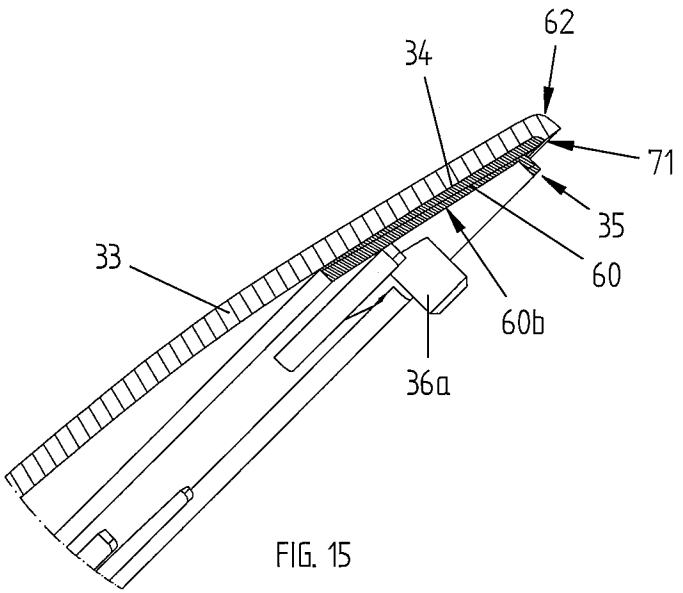
FIG. 15 shows a partial view of the door assembly of FIG. 13 sectioned along line XV°-XV°.

The opaque element 60 preferably has an annular shape and comprises an outer edge 71 and an inner edge 72. The inner edge 72 preferably defines an aperture 73 for said opaque element 60, as indicated in FIG. 13. The opaque element 60 is therefore substantially ring-shaped. The outer edge 71 of the opaque element 60 is preferably rounded-shaped.

In case the cap element 33 is at least partially transparent, the opaque ring 60 is visible from outside, i.e. when viewed laterally outwardly from the door assembly 10; with the action "viewed laterally outwardly" is intended as the view of the door, frontally to the front surface of the door assembly 10, preferably in a parallel direction with respect to the door assembly central axis X (i.e. according to the viewing direction indicated with "V" in FIGS. 7 and 8A).

As illustrated in FIGS. 7 and 8A, the outer edge 71 of the opaque ring 60 preferably borders the outer edge 62 of the cap element 33. Preferably, the outer edge 71 of the opaque ring 60 borders also the border edge 62 of the projecting portion 150, as illustrated in particular in FIG. 7.

In a preferred embodiment of the invention, the opaque ring 60 is made of a plastic material and is over-molded on the inner side 34 of the cap element 33 to preferably define a completed, integral, unitary member.

In different embodiments, the opaque ring may be differently fixed to the cap element in order to define a completed, integral, unitary member, for example by gluing.

Preferably, the opaque ring 60 and the cap element 33 are connected to the front side 6*a* of the front frame 6. More preferably, the opaque ring 60 and the cap element 33 are fixedly connected to the front frame 6 in order to define a completed, integral, unitary member.

Preferably, the opaque ring 60 at rear side 60*b* thereof comprises one or more ribs 35, facing the front frame 6, the ends of which allow welding of the opaque ring 60 to the front frame 6, for example through ultrasonic welding.

Preferably, the opaque ring 60 at rear side 60*b* thereof also comprises centering means 36 comprising pins 36*a* facing the front frame 6 and apt to be received in holes 36*b* realized in the front frame 6. Centering means 36 allow correct alignment of opaque ring 60 to the front frame 6 during manufacturing step, preferably during welding.

Preferably, the opaque ring 60 overlaps at least partially the peripheral zone of the front side 6*a* of the front frame 6. Advantageously, the opaque ring 60 hides said peripheral zone of the front side 6*a* of the front frame 6 which is therefore not visible from outside. Advantageously, the opaque ring 60 also preferably hides ribs 35 for connecting the opaque ring 60 to the front frame 6.

The opaque ring 60, therefore, gives a better aesthetic appearance to the door assembly 10, covering all possible elements which are present in the peripheral zone of the front side 6*a* of the front frame 6 and/or in the rear side 60*b* of the opaque ring 60.

In the preferred embodiment of the invention here illustrated and described, the outer edge 62 of the cap element 33 extends radially outwardly with respect to the outer edge 71 of the opaque ring 60, as illustrated in FIGS. 7 and 8A, i.e. a peripheral portion of the cap element 33 extends radially beyond the opaque ring 60. Furthermore, preferably, the outer edge 61 of the front frame 6 also extends radially outwardly with respect to the outer edge 71 of the opaque ring 60, i.e. a peripheral portion of the front frame 6 extends radially beyond the opaque ring 60.

Advantageously, in case the cap element 33 is at least partially transparent, it is possible to see the peripheral zone of the front frame 6 through the portion of the cap element 33 which extends beyond the opaque ring 60 when viewed laterally outwardly from the door assembly 10.

Also, advantageously, in case the cap element 33 is at least partially transparent, it is possible to see the outer edge 71 of the opaque ring 60. through the portion of the cap element 33 which extends beyond the opaque ring 60 when viewed laterally outwardly from the door assembly 10.

This further gives a better aesthetic appearance to the door assembly 10, in particular when the outer edge 71 is rounded-shaped, as in the present preferred embodiment.

As said above, the door assembly 10 is advantageously hinged and supported at the casing 7 of the machine 1, preferably at front wall 2 of the casing 7.

Door assembly 10, therefore, preferably comprises a hinge device 160 which is provided to pivot the door assembly 10 to the casing 7 so that it can be opened by rotating it about a hinge axis.

Hinge device 160 may be any conventional hinge, preferably of the type that is not visible when the door assembly 10 is closed.

In the embodiment shown in the figures, hinge device 160 comprises a base portion 161 apt to be fixed to the front wall 2 of the casing 7 (for example with screws) and two knuckles 162*a*, 162*b* extending from the base portion 161 which receive a pivot pin 163.

Knuckles 162*a*, 162*b* are advantageously received in the door assembly 10.

Preferably, the rear frame 5 comprises two apertures 152*a*, 152*b* apt to receive knuckles 162*a*, 162*b* therethrough.

Figure 18:
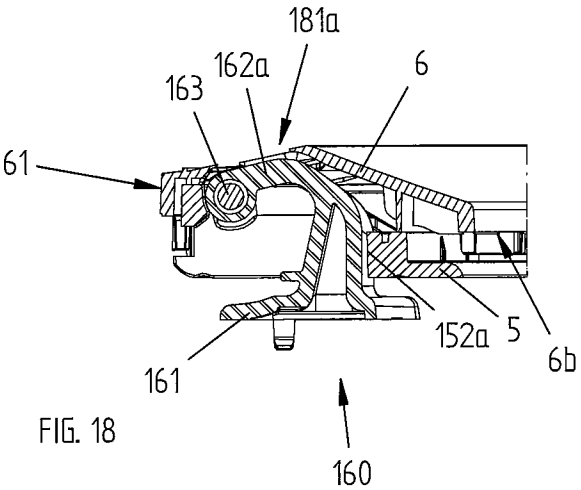
FIG. 18 shows a partial view of the door assembly of FIG. 16 sectioned along line XVIII°-XVIII°.

Preferably, the front frame 6 comprises apertures 151*a*, 151*b*, 181*a*, 181*b* apt to receive knuckles 162*a*, 162*b*, in particular to receive outer portions of knuckles 162*a*, 162*b* when the door assembly 10 is in its dosed position, as visible in particular in FIG. 18.

Nevertheless, advantageously, knuckles 162*a*, 162*b* and outer portions thereof are not visible from outside since opaque ring 60 preferably hides the same.

This guarantees the good aesthetic appearance of the door assembly 10.

According to a further preferred aspect of the present invention, front frame 6 and cap element 33 comprise a protective arrangement 200 for the apertures 181*a*, 181*b* of the front frame 6 which receive knuckles 162*a*, 162*b*.

Preferably, the protective arrangement 200 comprises barrier ribs 201, 202 of the front frame 6 and of cap element 33, respectively, which define a barrier surrounding apertures 181*a*, 181*b* when the front frame 6 and the cap element 33 are fixedly assembled together. Barrier ribs 201, 202 of the front frame 6 and of cap element 33 are preferably specular so as to substantially form a unique barrier when front frame 6 and cap element 33 are fixedly assembled together.

The unique barrier is preferably obtained by the interference fit of barrier ribs 201, 202 when the same are pushed together during assembling.

Barrier ribs 201,202 preferably comprise inclined terminal portions 201*a*, 202*a*.

Figure 17:
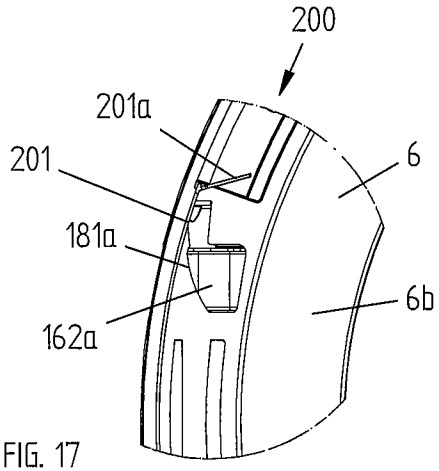
FIG. 17 shows an enlarged view of a detail of FIG. 16.

In particular, as illustrated in FIG. 17, inclined terminal portions 201*a*, 202*a* protect from above the apertures 181*a*, 181*b* in case liquids, usually water, inadvertently fall vertically at the door assembly 10.

Figure 19:
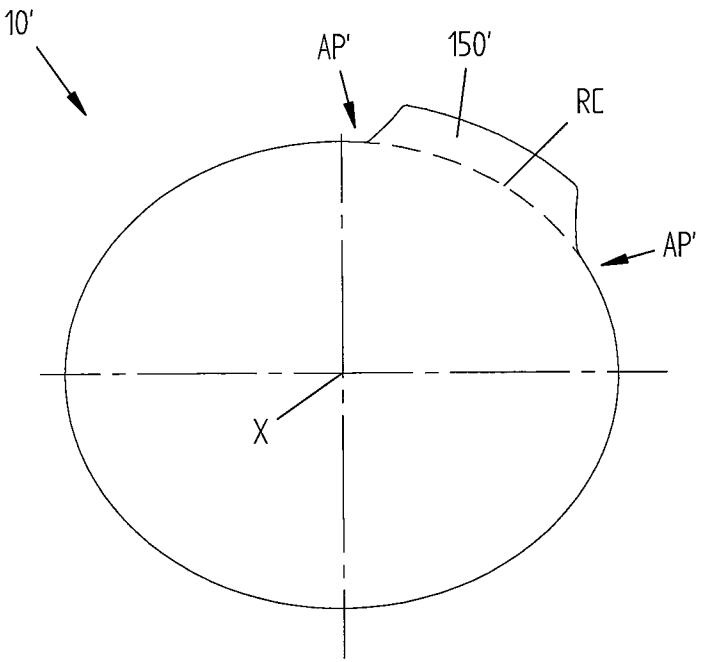

FIG. 19 schematically shows a door assembly 10' according to a further preferred embodiment of the invention wherein the regular contour RC, of the cap element and/or of the front frame, is preferably an oval and the projecting portion 150' is substantially preferably defined by an annular rim portion.

Preferably, therefore, the projecting portion 150' comprises a portion of the outer edge that locally extends in a circular path around the door assembly central axis X at a distance greater than the distance of adjacent outer edge portions, the latter being indicated with AP'.

Figure 20:
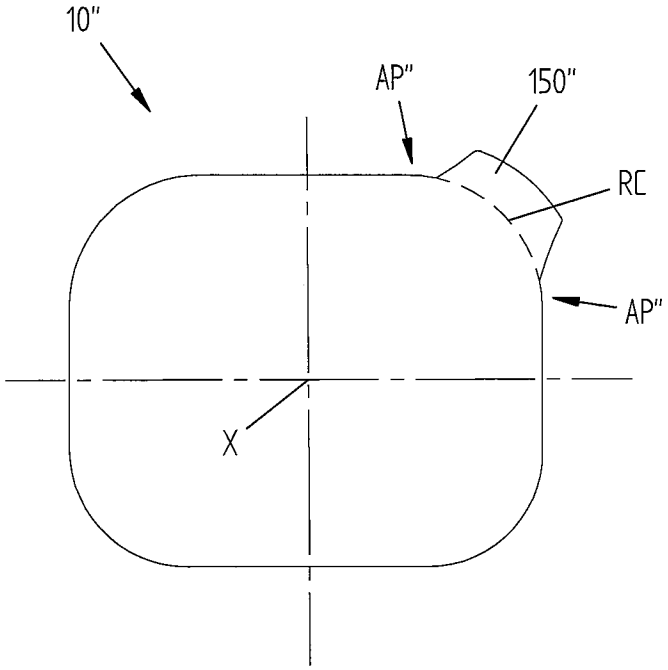
FIGS. 19 and 20 shows schematic plan views of door assemblies realized according to further preferred embodiments of the invention.

FIG. 20 schematically shows a door assembly 10" according to a further preferred embodiment of the invention wherein the regular contour RC, of the cap element and/or of the front frame, is preferably substantially rectangular and the projecting portion 150" is substantially preferably defined by an annular rim portion.

Preferably, therefore, the projecting portion 150" comprises a portion of the outer edge that locally extends in a circular path around the door assembly central axis X at a distance greater than the distance of adjacent outer edge portions, the latter being indicated with AP".

It has thus been shown that the present invention allows all the set objects to be achieved. In particular, it makes it possible to provide a laundry treatment machine that makes it possible to reduce manufacturing time and costs and improving aesthetic appearance.

It is underlined that the laundry washing machine illustrated in the enclosed figures is of the front-loading type; however it is clear that the system according to the invention can be applied as well to a top-loading washing machine, substantially without any modification.

While the present invention has beet described with reference to the particular embodiments shown in the figures, it should be noted that the present invention is not limited to the specific embodiments illustrated and described herein; on the contrary, further variants of the embodiments described herein fall within the scope of the present invention, which is defined in the claims.

The invention claimed is:

1. A door assembly configured to open and/or close an opening defined in a laundry treatment machine, the door assembly comprising:

a front frame; and a cap element outwardly assembled to the front frame, the cap element forming the front surface of the door assembly;

wherein the front frame has:

an outer frame edge having a frame portion extending in a first circular path defining a first circumference along a first plane around the door assembly, and a frame projecting portion defining a first portion of a handle for the door assembly, the frame projecting portion including a substantially flat outer surface extending radially outwardly from an inner frame boundary located on the first circumference along a second plane in a direction outwardly inclined from the front frame and continuously converging at an outer frame boundary located on the outer frame edge, and the frame projecting portion is integrally formed with the frame portion, and wherein the cap element has:

an outer cap edge having a cap portion extending in a second circular path defining a second circumference around the door assembly, and a cap projecting portion defining a second portion of the handle for the door assembly, the cap projecting portion including a substantially flat outer surface extending radially outwardly from an inner cap boundary located on the second circumference in the direction outwardly inclined from the front frame and continuously converging at an outer cap boundary located on the outer cap edge, and the cap projecting portion is integrally formed with the cap portion, wherein the outer frame edge of the frame projecting portion defining the first portion of the handle, and the outer cap edge of the cap projecting portion defining the second portion of the handle come together in a continuously converging manner in the direction outwardly inclined from the front frame to define the handle for the door assembly.

2. The door assembly according to claim 1, wherein the outer frame edge of the front frame follows the outer cap edge of the cap element.

3. The door assembly according to claim 1, wherein the cap element is at least partially transparent and comprises an inner side facing the front frame, wherein an opaque element comprising opaque material is arranged at the inner side of the cap element and between the front frame and the cap element.

4. The door assembly according to claim 3, wherein the opaque element comprises an outer edge which borders the outer cap edge of the cap element and borders the outer frame edge of the front frame.

5. The door assembly according to claim 3, wherein the opaque element is ring-shaped.

6. The door assembly according to claim 3, wherein the front frame comprises a front side and wherein the opaque element overlaps a peripheral zone of the front side of the front frame when viewed laterally outwardly from the door assembly.

7. The door assembly according to claim 1, wherein the front frame comprises at least an aperture configured to receive a portion of a hinge device of the door assembly.

8. The door assembly according to claim 1, further comprising a rear frame and a closing element arranged between the rear frame and the front frame, wherein the rear frame, the closing element and the front frame are assembled together.

9. The door assembly according to claim 3, wherein the cap element peripherally extends beyond the front frame and/or the opaque element so that a peripheral zone of the front frame is visible when viewed laterally outwardly from the door assembly.

10. The door assembly according to claim 1, wherein the outer cap edge comprises a radial protrusion and/or a bulge.

11. The door assembly according to claim 1, wherein the door assembly is a pull to open door assembly.

12. The door assembly according to claim 1, wherein the handle is fixed to be stationary relative to the front frame.

13. The door assembly according to claim 1, wherein the cap element is a closed element that does not include an aperture.

14. The door assembly according to claim 1, wherein the handle is defined only by the front frame and the cap element.

15. A laundry treatment machine comprising:

a casing including a wall on which an opening is formed; and a door assembly configured to open and/or close the opening, the door assembly comprising:

a front frame; and a cap element outwardly assembled to the front frame, the cap element forming the front surface of the door assembly;

wherein the front frame has:

an outer frame edge having a frame portion extending in a first circular path defining a first circumference along a first plane around the door assembly, and a frame projecting portion defining a first portion of a handle for the door assembly, the frame projecting portion including a substantially flat outer surface extending radially outwardly from an inner frame boundary located on the first circumference along a second plane in a direction outwardly inclined from the front frame and continuously converging at an outer frame boundary located on the outer frame edge, and the frame projecting portion is integrally formed with the frame portion, and wherein the cap element has:

an outer cap edge having a cap portion extending in a second circular path defining a second circumference around the door assembly, and a cap projecting portion defining a second portion of the handle for the door assembly, the cap projecting portion including a substantially flat outer surface extending radially outwardly from an inner cap boundary located on the second circumference in the direction outwardly inclined from the front frame and continuously converging at an outer cap boundary located on the outer cap edge, and the cap projecting portion is integrally formed with the cap portion, wherein the outer frame edge of the frame projecting portion defining the first portion of the handle, and the outer cap edge of the cap projecting portion defining the second portion of the handle come together in a continuously converging manner in the direction outwardly inclined from the front frame to define the handle for the door assembly.

* * * * *